US006913030B1

(12) United States Patent
Chmelik Martinec

(10) Patent No.: US 6,913,030 B1
(45) Date of Patent: Jul. 5, 2005

(54) PNEUMATIC UMBRELLA

(76) Inventor: Andrés Eduardo Chmelik Martinec, Tres Sargentos 422, Piso 1"6", Buenos Aires (AR) 1054

( * ) Notice: Subject to any disclaimer, the term of this patent is extended or adjusted under 35 U.S.C. 154(b) by 0 days.

(21) Appl. No.: 10/701,437

(22) Filed: Apr. 27, 2004

(51) Int. Cl.[7] ..... A45B 19/02; A45B 25/14
(52) U.S. Cl. ..... 135/20.2; 135/20.3
(58) Field of Search ..... 135/20.2, 20.3

(56) References Cited

U.S. PATENT DOCUMENTS

| | | | | |
|---|---|---|---|---|
| 1,411,560 A | * | 4/1922 | Beaty | 135/20.2 |
| 2,625,946 A | * | 1/1953 | Kaston et al. | 135/20.2 |
| 2,753,878 A | * | 7/1956 | Halberstam | 135/20.2 |
| 3,361,145 A | * | 1/1968 | Jones | 135/20.2 |
| 3,954,117 A | * | 5/1976 | Wallace | 135/20.2 |
| 4,747,422 A | * | 5/1988 | Chung | 135/20.2 |

* cited by examiner

*Primary Examiner*—Robert Canfield
(74) *Attorney, Agent, or Firm*—Jacobson Holman PLLC

(57) ABSTRACT

An umbrella with pneumatic activation, specifically a portable, foldable umbrella, for the protection of persons from the rain and sun, and to be employed in fixed installations of one or more umbrellas as well, to protect crops, objects, or surfaces that require controlled protection, outdoor tables, beaches, and patios as principal examples of operation and use with individual or centralized control. When connected together, a group of umbrellas are controlled with a unified command, or through an automated system with temperature and water sensors. An automatic compressor could be provided to activate and deactivate the system, and it also could be activated within a closed circuit with a pressurized air storage chamber. A pneumatic umbrella that, in addition to the handle, or base, has a complete pneumatic circuit with entry and exit of air, equipment for pumping the air, a valve controlling the flow of air to either open or close the umbrella through internal conduits which are connected to extendable stems and are held together by a threaded system.

3 Claims, 2 Drawing Sheets

PNEUMATIC UMBRELLA

FIELD OF THE INVENTION

The present invention refers to a pneumatically activated umbrella, specifically to a portable, foldable umbrella, for the protection of persons from the rain and sun, and to be employed in fixed installations of one or more umbrellas as well, to protect crops, objects, or surfaces that require controlled protection, outdoor tables, beaches, and patios as principal examples of operation and use with individual or centralized control that, connected together, controls a group of umbrellas with a unified command, or through an automated system with temperature and water sensors; furthermore, an automatic compressor could be provided to activate and deactivate the system, and it also could be activated within a closed circuit with a pressurized air storage chamber.

The principal objective of the proposed invention is a pneumatic umbrella that, in addition to the handle, or base, has a complete pneumatic circuit with entry and exit of air, equipment for pumping the air, a directive valve controlling the flow of air to either open or close the umbrella through internal conduits installed in the fabric which are connected to extendable stems and are held together by means of a threaded system.

BACKGROUND OF THE INVENTION

A great number of constructive modalities are known to the art of making umbrellas and parasols. In all, they offer various solutions to the folding and require a great number of small, articulated parts and pieces.

The present invention, on the other hand, offers the function of protection with a saving of a large number of articulated parts, which in general are not very durable, by means of a flexible mushroom-shaped hemisphere without mechanical parts.

Construction is thereby simplified and longer life guaranteed, in comparison between the durability of articulated mechanical parts and flexible parts that serve the same function.

SUMMARY OF THE INVENTION

To that end the present invention proposes a pneumatically activated umbrella for fixed installations of one or more pieces of equipment, to protect crops, objects, or surfaces that require controlled protection, outdoor tables, beaches, and patios as principal examples of operation and use with individual or centralized control that, connected together, controls a group of umbrellas with a unified command, or through an automated system with temperature and water sensors; furthermore, an automatic compressor could be provided to activate and deactivate the system.

The proposed umbrella offers the particularity of being made up of rigid sliding parts, each of which supports the others in extending, making up an axis or column, integrated with other more flexible parts, all of which together constitute a hemisphere or mushroom head, through the action of pre-established pneumatic circuit, by means of a manually-operated pump, with which it is equipped, and which is controlled with a valve specifically designed for the purpose, activated by a command switch for compression, closing, and decompression of the pneumatic system, which is the means that make it capable of unfurling the rigid parts that make up the axis column and the flexible parts that make up the hemisphere or mushroom head, hold them together, and later fold them up.

DESCRIPTION OF THE PREFERRED FORM OF THE INVENTION

Figures 1, 2, 4, 5, 7:
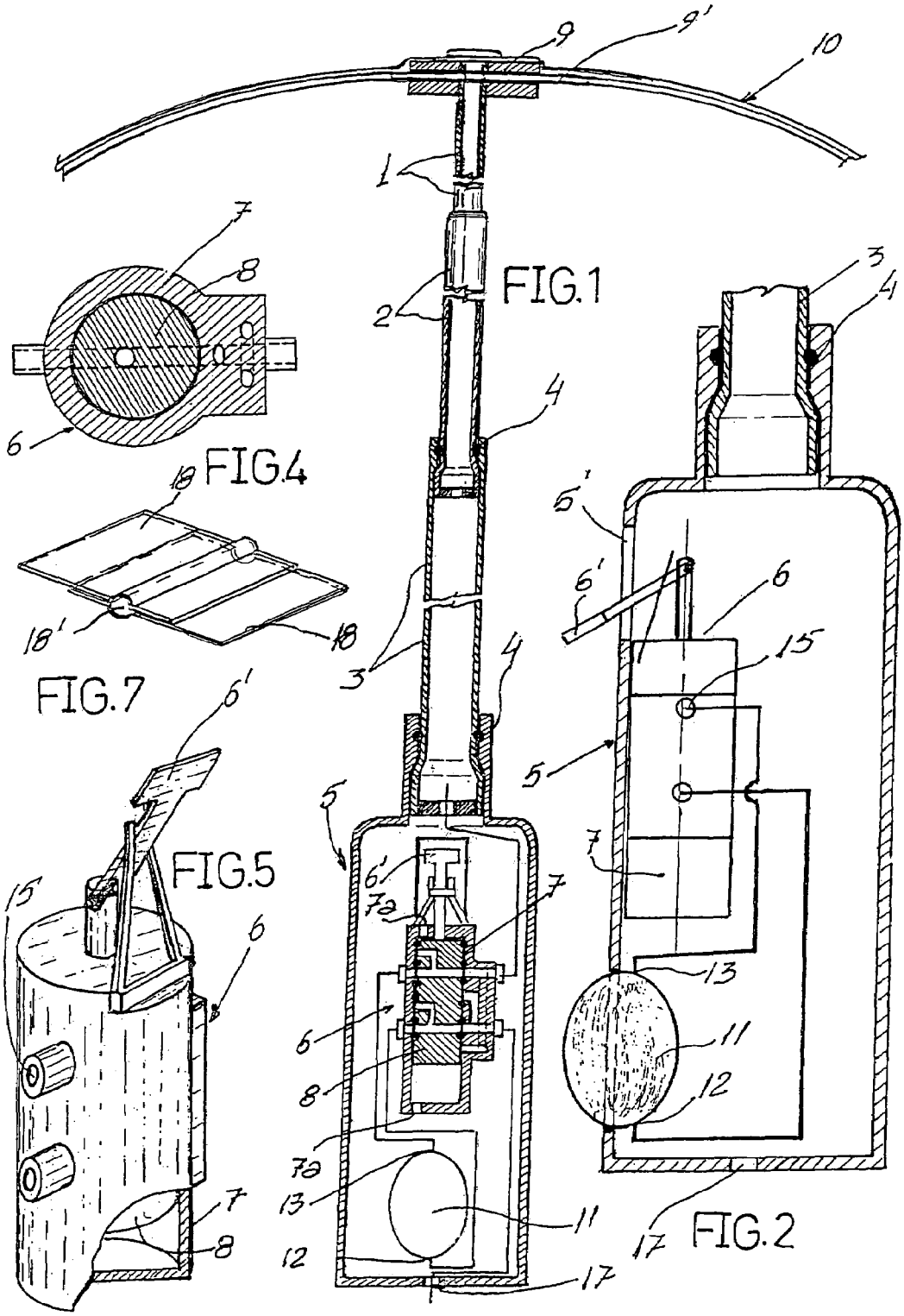
FIG. 1 represents a side elevation view with a partial section of the pneumatic umbrella in a first configuration, object of the present invention.
FIG. 2 represents a detailed view and section of the handle or stem of the umbrella.
FIG. 4 represents a view of a transversal section of the valve that directs the flow of air.
FIG. 5 represents a view in perspective and a section of the valve that directs the flow of air.
FIG. 7 represents a detailed view and section of the upper end of the umbrella in a second configuration.
Figure 6A:
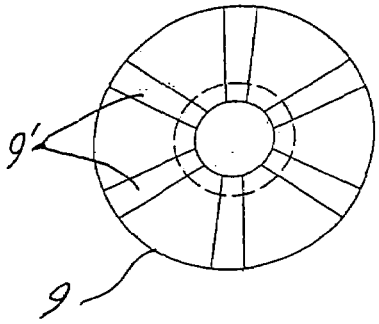
FIGS. 6 and 6*a* represent corresponding views, in side elevation, section and overall of the upper end of the umbrella.
Figure 6:
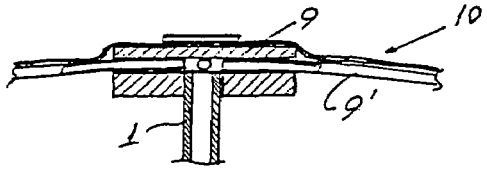
Figure 3A:
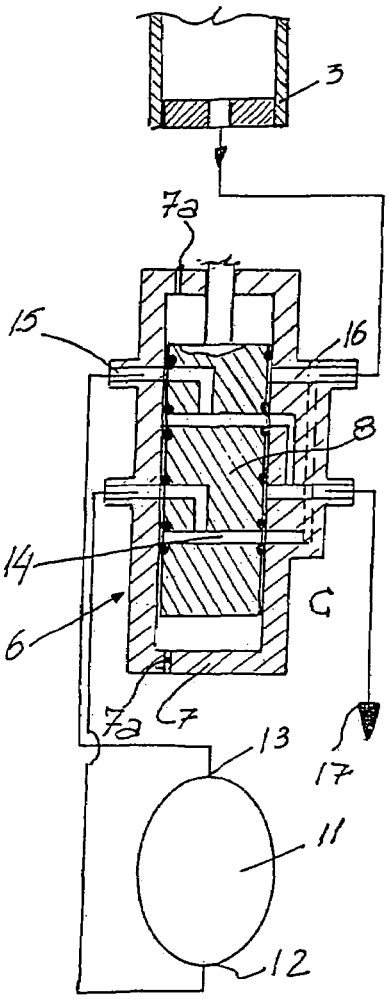
FIGS. 3*a, b*, and *c* represent corresponding longitudinal sections of the valve that directs the air in its three operating positions.
Figure 3B:
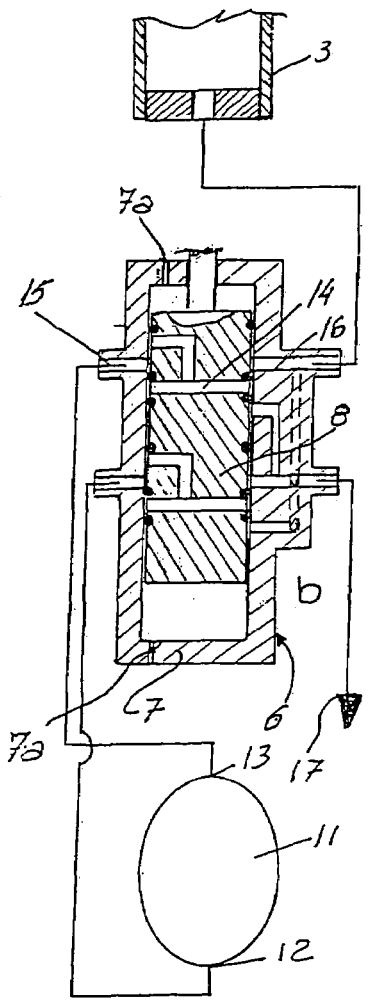
Figure 3C:
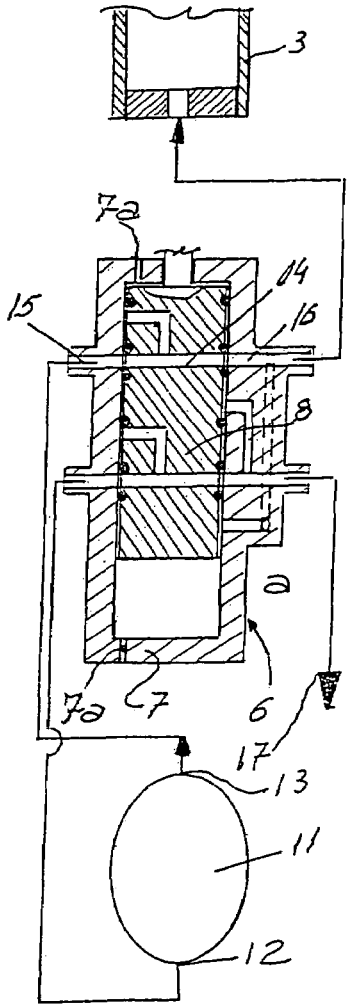

In accordance with the illustration represented in the figures of the drawings, the pneumatic umbrella, in a first configuration, is constituted of a pair of tubular portions one encapsulated in the other (1), (2), and (3), provided with their respective "O-rings" (4). The tubular portion (3) remains fixed in the hollow body (5) the lateral wall which has a first opening (5') from which a command lever emerges (6') that activates a valve that directs the flow of air (6), located on the internal surface of the side wall of the hollow body (5). The aforementioned valve that directs the flow of air (6) is composed of a blank sleeve (7) closed at the end with air entrance and exit orifices (7*a*) define compensatory conduits located on the interior of the aforementioned sleeve (7). The piston (8) inside the sleeve is provided with longitudinal and transversal passages some of which, in the piston's alternative positions, coincide with passages made in the sleeve (7), connected to air entrance and exit conduits corresponding to the outside and to the tubular sections (1), (2), and (3). The tubular portion (1) is connected to a disc-shaped piece (9) provided with angularly spaced air conduits (9') that allows furling and unfurling of the hemispheric mushroom head (10).

The behavior of the umbrella in question in its two operating stages, furled and unfurled, includes steps during the inflation stage, putting the valve that directs the flow of air (6) in the position to inflate. In accordance with FIG. (3*a*) the pneumatic chamber (11) is pressed by hand. That action turns on the air pump equipment. The pressure closes valve (12) and opens valve (13). That allows the air to pass through the valve that directs the flow of air (6) in the direction of the tubular portions (1), (2), and (3). The air travels through passage (14) and exit (16) and after that, through the disc-shaped piece (9), flowing into the fabric through the air conduits (9').

When the pressure of the hand on the pneumatic chamber (11) is released, the pneumatic chamber recovers its original position since it is constructed of a flexible material. Carrying out that maneuver produces a depression within the chamber that closes valve (13) and opens valve (12), making a connection with the entry of air through a hole (17) made in the base of the sleeve (5). The aforementioned steps are repeated in alternation until the umbrella is fully inflated.

When the inflation maneuver is considered finalized, the valve that controls the flow of air (6) is positioned in the neutral position, FIG. (3*b*), and the umbrella stays in the inflated state.

To deflate the umbrella, the valve that controls the flow of air (6) is placed in the position of FIG. (3*c*). At this stage, and due to the difference of pressure (greater pressure in the head (10) of the umbrella) the air will flow quite rapidly from the head (10), pass through the directive valve and enter the chamber (11) by the open conduit (12), exit via conduit (13), also open. It passes again through the valve that controls the flow of air (6) and exits through the orifice (17) of the air entry/exit located in the lower base of the hollow body (5). When the pressure is equalized (atmospheric pressure at all points) there is no current of air and in order to completely remove the air that still remains out of the system it will be necessary to proceed in a manner analogous to stages (a) and (b) of the process of inflating the umbrella.

It must be emphasized that because of the position of the valve that controls the flow of air (6) when the aforementioned directive valve expels the air, the air will flow toward the air exit orifice (17), and when it is taking the air in, the air will enter the circuit formed by the tubular portions (1), (2), (3) and the mushroom-shaped head.

The user will decide the time in which he considers the deflated state to be finalized. At that instant he will again position the valve that controls the flow of air (6) in the neutral position, FIG. (3*b*), and proceed to fold the umbrella.

In a second configuration, the mushroom-shaped head (10) is defined by the superposition of cloth panels (18) or similar construction that defines radial passages (18').

The hemisphere, or mushroom-shaped head (10), may be constructed, in accordance with different necessities or uses, of conduits of pre-molded flexible plastic tubes 2 to 7 mm across, approximately. Such tubes make up the radial arcs and, possibly, the perimeter of the head itself when the pneumatic system expands. In that case they would have a covering adhered to the exterior face. That could be accomplished with a single pre-molded plastic sheet, or in any manner.

Along its outer edges, the hemisphere, or mushroom-shaped head (10), has reinforcement in the form of guys, the thickness of which may vary as needed, and which serve as a means of stabilization of the aforesaid hemisphere, or mushroom-shaped portion. The guys are connected directly to the sleeve of the umbrella.

What is claimed is:

1. A pneumatically activated umbrella comprising a sleeve connected to tubular portions encapsulated in one another to furl and unfurl a system of rods that support a fabric covering; the tubular portions encapsulated in one another possess respective O-rings so as to define a longitudinal conduit in communication at its bottom end with a valve that directs the flow of air; the conduit being a blind sleeve within which a sliding piston provided with longitudinal and transversal passages and its own O-rings; said passages, being in a position to communicate with further passages in the sleeve, for the entry and exit of the flow of air produced by a pump for two operating positions, open and closed, and in a neutral position with reference to communication with orifices passing through the sleeve to the outside; the upper end of said tubular portions communicate with a disc-shaped piece provided with conduits arranged in a radial manner around the central axis and in communication with passages in the covering of the umbrella's mushroom-shaped portion.

2. The umbrella as claimed in claim 1, further comprising a valve for controlling the entry, retention and egress of air from a pre-established pneumatic circuit in individual use or for an integrated system.

3. The umbrella as claimed in claim 1, further comprising a hemisphere or mushroom-shaped portion in a pneumatic circuit with a small interior volume within a system of radial hoops constructed with conduits of plastic material that are capable of various degrees of flexibility, that is also unfurled due to the fact that each has a specific thickness, or a corrugated sector of the wall, so as to facilitate the unfurling; allowing air to enter the pneumatic circuit, the expansion of the system will create the resistance that it requires; the fabric cover being glued or sewed to ribs that contain the conduits or directly to the conduits, the fabric forming the exterior face.

* * * * *